US007162230B2

(12) United States Patent
Inokoshi et al.

(10) Patent No.: US 7,162,230 B2
(45) Date of Patent: Jan. 9, 2007

(54) RADIO-CONTROLLED DEVICE

(75) Inventors: Satoshi Inokoshi, Mobara (JP); Yuuki Hayashi, Mobara (JP); Michio Fujisaki, Mobara (JP)

(73) Assignee: Futaba Corporation, Chiba-ken (JP)

( * ) Notice: Subject to any disclaimer, the term of this patent is extended or adjusted under 35 U.S.C. 154(b) by 587 days.

(21) Appl. No.: 10/435,722

(22) Filed: May 8, 2003

(65) Prior Publication Data

US 2003/0211832 A1 Nov. 13, 2003

(30) Foreign Application Priority Data

May 10, 2002 (JP) ..... 2002-135735

(51) Int. Cl.
*H04M 3/00* (2006.01)
*H04B 7/00* (2006.01)
*H04H 7/00* (2006.01)

(52) U.S. Cl. ..... 455/418; 455/419; 455/420; 455/3.06; 455/450; 455/41.2

(58) Field of Classification Search ..... 455/418–420, 455/3.06, 450–452.1, 516, 41.2, 41.3, 39, 455/73

See application file for complete search history.

(56) References Cited

U.S. PATENT DOCUMENTS 5,087,000 A * 2/1992 Suto ..... 244/189
6,810,087 B1 * 10/2004 Hoctor et al. ..... 375/259

* cited by examiner

*Primary Examiner*—Matthew Anderson
*Assistant Examiner*—Eugene Yun
(74) *Attorney, Agent, or Firm*—Quarles & Brady LLP

(57) ABSTRACT

A radio-controlled device is provided that has improved steering responsivity. The radio-controlled device consists of a transmitter, a receiver, and digital servomechanisms. A PPM signal format of signals transmitted from the transmitter is shown in FIG. 4(*a*). Signals having time widths (T1, T2, t3) proportional to displacements of a transmitter joystick are distributed to drive the servomechanisms. As shown in FIG. 4(*b*), the transmission side transmits, to a final channel CH3, a signal having a time width of T3 (=t3+R), being the sum of the time width t3 and a reset reference value R (Nt3–Nt1). The receiver side subtracts the reset reference value R, thus restoring it to the original time width t3. By adding the reset reference value R, the minimum value L3 of a signal in the final channel is larger than the maximum value V1 of other signal.

4 Claims, 10 Drawing Sheets

NP: NEUTRAL POSITION
α: UPPER/LOWER LIMIT (MAXIMUM) OPERATION ANGLE
β: UPPER/LOWER LIMIT (MAXIMUM) DISPLACEMENT

NP: NEUTRAL POSITION

α: UPPER/LOWER LIMIT (MAXIMUM) OPERATION ANGLE

β: UPPER/LOWER LIMIT (MAXIMUM) DISPLACEMENT

FIG.5

| EXAMPLE OF SIGNAL WIDTH (TIME) (μs IN UNIT) | | |
|---|---|---|
| ONE-SHOT PULSE | a | 400 |
| MAXIMUM HALF-WIDTH TIME OF SIGNAL | τ | 600 |
| MARGIN WIDTH | q | 400 |
| MARGIN WIDTH 2 | q1 | 120 |
| LOWER LIMIT ALLOWABLE VALUE (qL=2a+q1=2×400+120=920=L1) | qL | 920 |
| RESET REFERENCE VALUE (R=Nt3-Nt1=3120-1520=1600=2τ+q) | R | 1600 |

| | | T1, T2 (CH1, CH2) | | T3 (FINAL PULSE) (CH3···CH(N)) | |
|---|---|---|---|---|---|
| SIGNAL UPPER LIMIT VALUE | U | U1 | 2120 | U3 | 3720 |
| (U=Nt+τ | | =1520+600 | | =3120+600) | |
| NEUTRAL POSITION | Nt | Nt1 | 1520 | Nt3 | 3120 |
| SIGNAL LOWER LIMIT VALUE | L | L1 | 920 | L3 | 2520 |
| (L=N-τ | | =1520-600 | | =3120-600) | |

RADIO-CONTROLLED DEVICE

CROSS REFERENCES TO RELATED APPLICATIONS

Not Applicable

STATEMENT REGARDING FEDERALLY SPONSORED RESEARCH

Not Applicable

BACKGROUND OF THE INVENTION

The present invention relates to a radio-controlled device that controls a mobile object. Particularly, the present invention relates to a radio-controlled device suitable for use with radio-controlled cars requiring instantaneous response characteristics.

A radio-control (R/C) technique is used to control mobile objects as equipment subject to control, such as small model cars, model aircraft, and model ships. Generally, plural sets of control information are used to operate the control object. For example, in order to manipulate a model car, three kinds of control information, related to directional (steering) control, forward movement (accelerating), and stopping (braking), are created and used as control signals.

FIG. 8 shows the outline of the radio-controlled device, a transmitter 50 consists of a controller 51, an encoder 52, a high-frequency section 53, and an antenna 54. The controller 51 has levers or joysticks 51*a* each for manipulating a mobile object, or an object subject to control, for example, a model car (hereinafter, referred to as a radio-controlled car) 55, and various setting switches. While the switch 51*a* is rotated with fingers, the volume (potentiometer) 51*b* connected to the joystick 51*a* rotates together. Thus, control signals proportional to rotational angles of the joystick are created via the voltage indicated by the volume 51*b*. The encoder 52 performs a PPM conversion and converts various signals output from the controller 51 into a chain of pulses serially-arranged concluded in a predetermined frame period. While a radio-controlled car is being operated, the high-frequency section 53 (transmission section) receives the chain of pulses and the antenna 54 radiates AM- or FM-modulated carriers at all times. In a contest, a manipulator, or a player, carries a transmitter while operating a joystick 51*a* to move a radio-controlled model car 55 at a remote place.

FIG. 9 is a block diagram illustrating a receiver 60 mounted on the radio-controlled model car 55. The antenna 61 receives radio waves transmitted by the transmitter shown in FIG. 8. The decoder 65 decodes the radio waves into a PPM signal via the tuner 62, the converter 63 connected to the local-oscillator 64, and the IF amplifier/FM detection circuit 67. The decoder signal output is distributed to each servomechanism. Each servomotor is driven by each signal to control the direction and speed of the radio-controlled model car. Normally, in order to indicate the current rotational position of the output shaft of a servomechanism, a potentiometer is connected to the output shaft thereof. In control, the rotational angle of the output shaft of the servomechanism is substantially proportional to the operation angle of the joystick.

FIG. 10 is an example of a format of control signals created by the encoder 52 in the transmitter 50. Referring to FIG. 10, the horizontal axis represents a time axis with time lapsing from left to right. The PPM converted control signals are respectively shown as signals T1 to T3 arranged in the order of CH1 to CH3. The duration of each signal corresponds to a position (angle) of a joystick 51*a*. One shot pulse S is created at the beginning of a signal corresponding to each channel. The time period (time width) between the start time of one-shot pulse S and the start time of the next one-shot pulse S corresponds to T1, T2, or T3.

Symbol S1, S2, S3, or SR is attached to one-shot pulse S. The time period between one-shot pulse S1 showing the beginning of the channel (CH1) and the next one-shot pulse S1 forms one frame. The frame is created sequentially and transmitted seamlessly. Each of signals T1 and T3 in each channel has a minimum time width of 900 μs and a maximum time width of 2100 μs. Each of the signals T1 to T3 has the time period proportional to an operation amount of the corresponding joystick 51*a*. Thus, the total of the signal time periods in the three channels ranges from a minimum value of 2700 μs to a maximum value of 6300 μs.

One-shot pulse SR formed at the end of the channel 3 (CH3) is used as a reset pulse R. Referring to FIG. 10, symbols S1, S2, S3, or SR are distinctively attached to one-shot pulse S. All one-shot pulses S have the same pulse width (a) and the same shape. Even when the receiver side receives a sole pulse, whether or not what symbol it belongs to cannot be specified. In order to specify one-shot pulse S1 and to decide the signal T1, non-signal time period between one-shot pulse S1 from the rise time of the reset pulse SR, or a reset signal, and one-shot pulse S1 showing the beginning of the next channel is at least 5 ms (5000 μs), different from a maximum interval of 2100 μs of other pulses.

When one-shot pulse S cannot be received because of, for example, noises, the receiver side cannot specify whether or not what channel it belongs to. In such a case, a pulse interval is measured and a reset signal set to a longer time than 5 ms is decided. Thus, it is assumed that the one-shot pulse S to be received next is the one-shot pulse S1. It is assumed that a new frame begins from the one-shot pulse S1. Thus, one-shot pulses S1, S2 and S3 at the beginnings of respective channels serially-arranged channels are specified.

In the block diagram shown in FIG. 9, the (PPM) decoder circuit 65 extracts reset data through an analog process. As shown with the column RES of FIG. 10, the RC circuit in the decoder 65 is charged via the inverter 66 for the duration only of the signals T1 to T3 and then is discharged with the next one-shot pulse S. Because the duration of the signal T1 to T3 is short, the charging voltage does not exceed the threshold value shown with the broken lines. However, because the reset signal SR has a sufficient long period of time, the charging voltage exceeds the threshold value and is recognized as a rest signal.

For the conventional servomotor, the frame length must be fixed to stabilize the operation. Even if all channel pulses are changed to a maximum value, the reset pulse must be set to a larger value. For that reason, the more the number of channels is increased, the more the frame length is prolonged. In order to obtain stability of the servomechanism, it is desirable to provide a margin time period per frame and to maintain the constant duration of each frame. Hence, the length of one frame is fixed to, for example, 14 ms. The non-signal duration of the reset signal is changed to deal with a variation of the total of the signal time widths of respective channels. Thus, making the reset signal longer than other signals and maintaining the time period of one frame to a constant value are required to cope with the mixing of noise and with stable drive operation of the servomechanism.

In the above system, information on position of a joystick is captured as a voltage indicated by a volume connected directly to the joystick at the points of the beginnings of one-shot pulses S1 to S3. The signals corresponding to the duration T1 to T3 are supplied as the pulses (hatched) to respective servomechanisms, once for one frame. Consequently, the travel angle of the joystick after an end of capture is not transmitted as stick travel information until one-shot pulses S1 to S3 corresponding to the next frame begin. That is, a maximum time of 14 ms corresponding to the length of one frame becomes non-operation area where the servomechanism does not follow the movement of the joystick. To the extent of non-operation area, a time difference occurs between movement of the joystick and the movement of a servomechanism. This results in poor control responsivity.

Servomechanisms used for general radio-controlled devices have a maximum operation angle of 60° to one side. In the operational speed of servomechanisms for model cars, it takes 100 to 150 ms to rotate the output shaft by 60°. That is, even when the signal having a time width corresponding to the maximum operation angle, the output shaft of each servomechanism is completely moved after a lapse of the time period corresponding to several frames. Accordingly, when the servomechanism operates nearly to the fullest extent, it is difficult that the conventional radio-controlled device senses non-operation area, which has 10 ms corresponding to less than 10% of the fullest extent. Thus, that system will not occur any problem. Moreover, with a small operation angle or the case where the servomechanism completely operates within the time period of one frame, the player is not often conscious of the delay of 10 ms in tracking, as a whole.

However, in the case of the radio-controlled model car contest for contending for, particularly, car speed, top-level players can often repeat minute displacements of the joystick at very high rate at the corner of a racing circuit for competition. Because of their natural abilities or skills, they can finger the joystick at a rate of 10 ms or less. It is considered that they have an unusual ability detectable a minute time. The time period of several tens ms of the non-operational area of the servomechanism corresponds to a change of several tens cm in position, when the speed of the current radio-controlled model car is converted into distance. During the change in position, the radio-controlled model car does not respond to any delicate, repeat operation of the joystick. Top players have been dissatisfied with the fact that the response characteristic of the current radio-controlled device, to which the servomechanism cannot track to the joystick operation by fingers, does not fully draw their steering skills. In order to gain ascendancy in competition, there have been strong demands for improved responsivity of the servomechanism that can follow quick finger movement.

A limited number of players are ranked among the tops. However, radio controlled model cars in which good results have been proven by the first-ranking players will show outstanding advertisement effects. Hence, because the superior-performance-proven model cars are expected to lead to a large volume of sales, improving the response characteristics of a servomechanism is a significant challenge to the business strategy.

Recently, a digital servomechanisms in an autonomous control system, each which uses a servomotor stably operating without fixing the frame length, have appeared on the market. The digital servomechanism does not require the frame length required in the conventional art but operates stably with the short frame length. That is, the use of the digital servomechanism allows the time period of one frame to be reduced in the driving of the servomechanism.

SUMMARY OF THE INVENTION

The present invention is made to solve the above problems.

An advantage of the invention is to provide a radio-control device adopting digital servomechanisms and having improved response characteristics.

In an aspect of the present invention, a radio-controlled device comprises a transmitter for serially arranging control signals in plural channels and transmitting the control signals as PPM-modulated carrier waves; a receiver for receiving and decoding the carrier waves and thus restoring the carrier waves to control signals for the plural channels; and a servomechanism for converting the plural control signals into mechanical displacements, respectively. The transmitter has modulation-signal reference value addition means for adding a modulation-signal reference value to control signals of remaining channels, except a final channel arranged at the end of the plural channels, and adding a reset modulation-signal reference value to only the control signal of the final channel. The receiver has reset reference value subtraction means for subtracting a reset reference value from the control signal of the final channel decoded.

Further, in the radio-controlled device of the present invention, the servomechanism comprises a digital servomechanism. Still further in the radio-controlled device of the present invention, the reset reference value is larger than a value twice at least a maximum half-width time of the control signal. The reset reference value is obtained by adding a predetermined margin time to a value twice the maximum half-width time of the control signal.

BRIEF DESCRIPTION OF THE DRAWINGS

This and other features and advantages of the present invention will become more apparent upon a reading of the following detailed description and drawings, in which:

FIG. 5 is a table listing an example of the time width of a PPM signal created in a radio-controlled transmitter according to the present invention;

DETAILED DESCRIPTION OF THE PREFERRED EMBODIMENTS

Three channels for a radio-controlled model car will be described below as an embodiment according to the present invention. However, the number of channels used for the radio-controlled model car is not limited. For example, 2 to 8 channels can be adopted. This technique is broadly used for radio control for aircraft, helicopters, ships, and equivalents.

The radio-controlled device generally consists of a transmitter for converting plural control signals into a serial form and transmitting it with radio waves, a receiver for receiving and decoding the radio waves into the plural control signals, and servomechanisms each for converting each control signal to a mechanical operation. When the servomechanism is the digital servomechanism described above, the frame length is not limited in the operation of the servomechanism.

Recently, the radio-controlled device generally uses a proportional control system. That is, the output voltage of the FET amplifier is controllably varied in proportional to the operation angle of a joystick built-in the transmitter. The FET amplifier controls the operation angle of the output shaft of a servomechanism and the rotational speed of the driving motor, on the receiving side.

Figure 1:
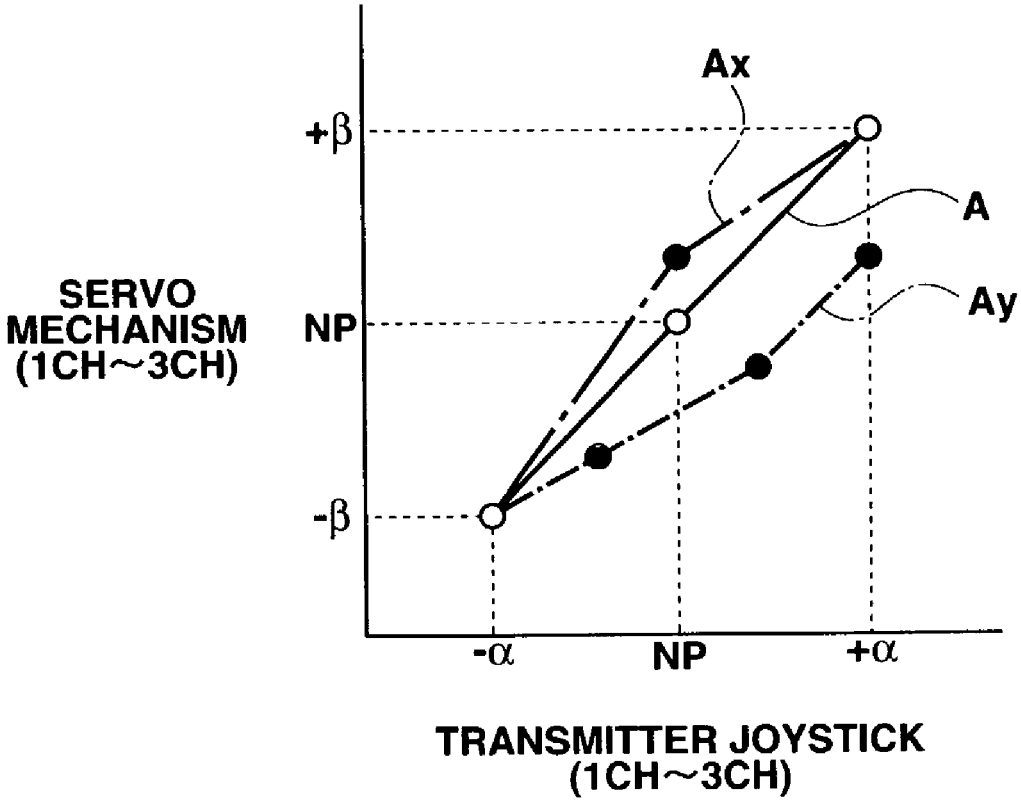
FIG. 1 is a schematic diagram explaining relationships between control angles of a joystick of a radio-controlled transmitter and displacements (angles) of a servo mechanism.

FIG. 1 schematically shows the relationships between operation angles of a joystick on the horizontal axis and rotational angles of the output shaft of a servomechanism on the vertical axis. For example, when the joystick for one channel tilts from the neutral position NP to a maximum operation angle of $+\alpha°$, the servo output shaft for the one channel moves from the neutral position NP to $+\beta°$ along the linear line (A). When the joystick is at an intermediate position, the servo output shaft moves to the position proportional to the intermediate position thereof along the linear line (A). The transmitter transmits carriers modulated with the position information of the joystick. The receiver decodes the carriers and drives respective servomechanisms. The movement along the linear line (A), shown FIG. 1, is completely in direct proportion. However, some transmitters employ the setting scheme that can partially adjust by setting in accordance with line segments with different gradients linked together, like the broken lines Ax and Ay as shown with chain lines. In order to avoid the complexity, explanation will be made below to a direct proportional relationship along the one linear line (A) being a basic configuration.

Figure 2:
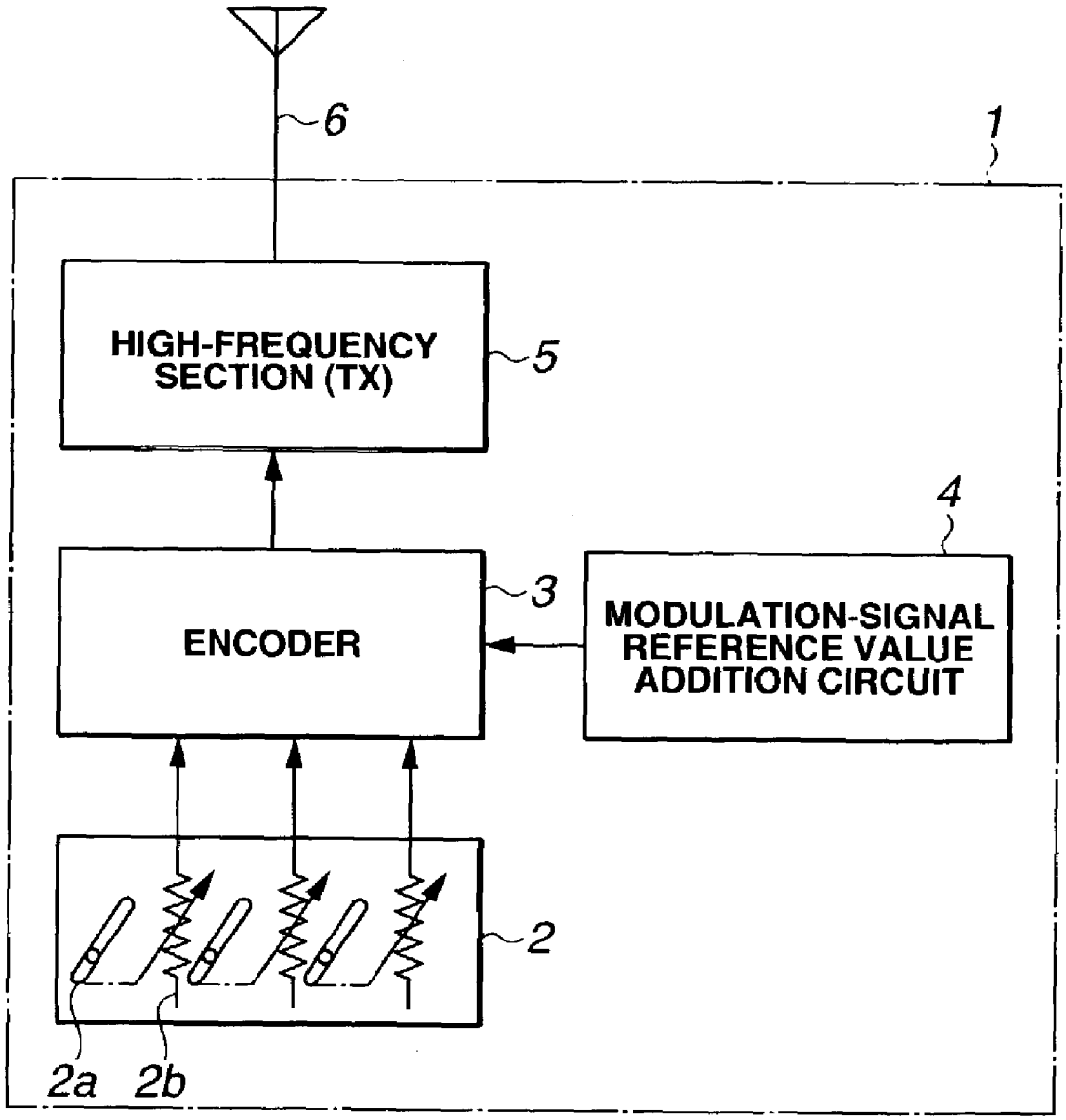
FIG. 2 is a block diagram illustrating the circuit configuration of a transmitter constituting a radio-controlled device according to the present invention.
Figure 8:
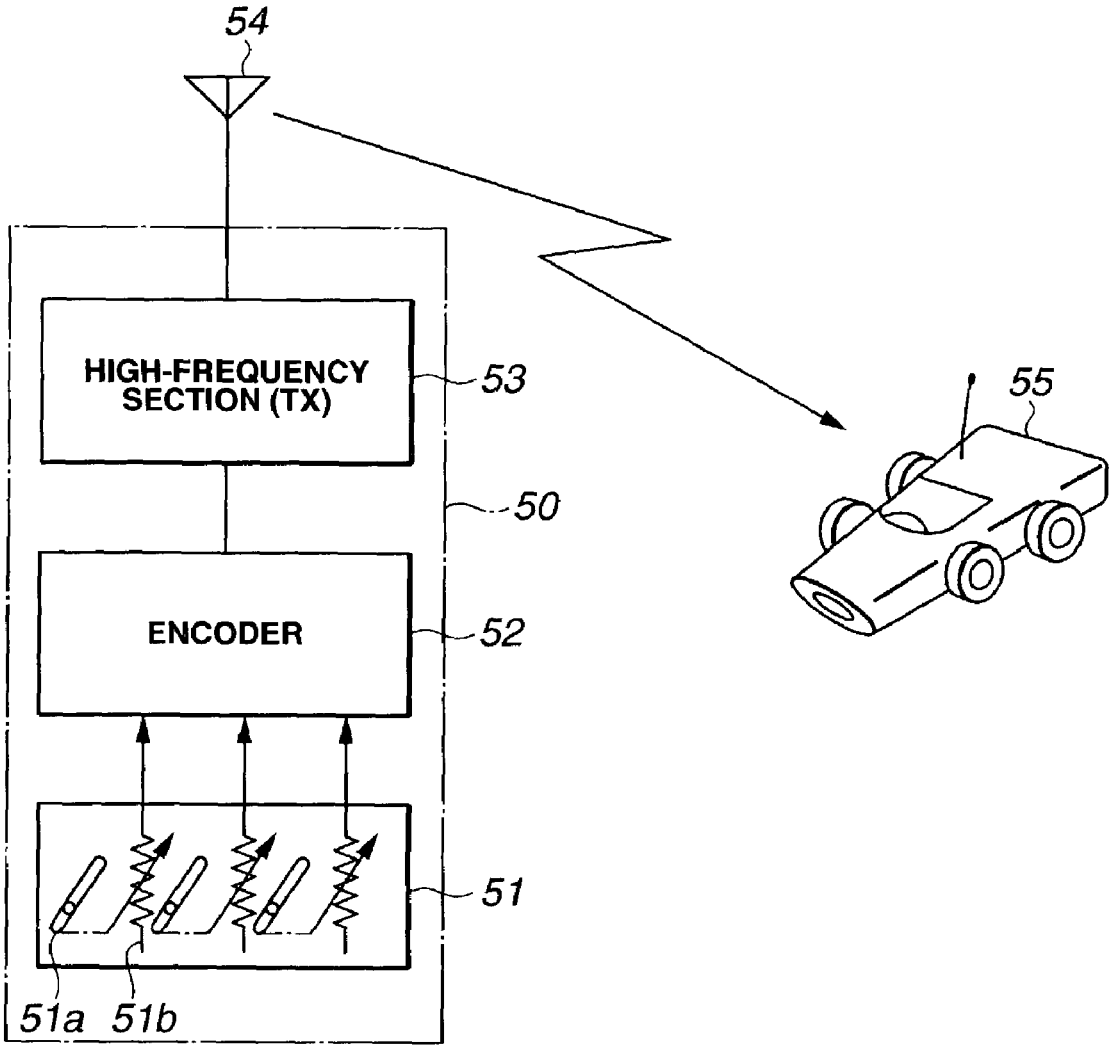
FIG. 8 is a general explanatory diagram showing a radio-controlled device for used in, for example, a radio-controlled model car.
Figure 9:
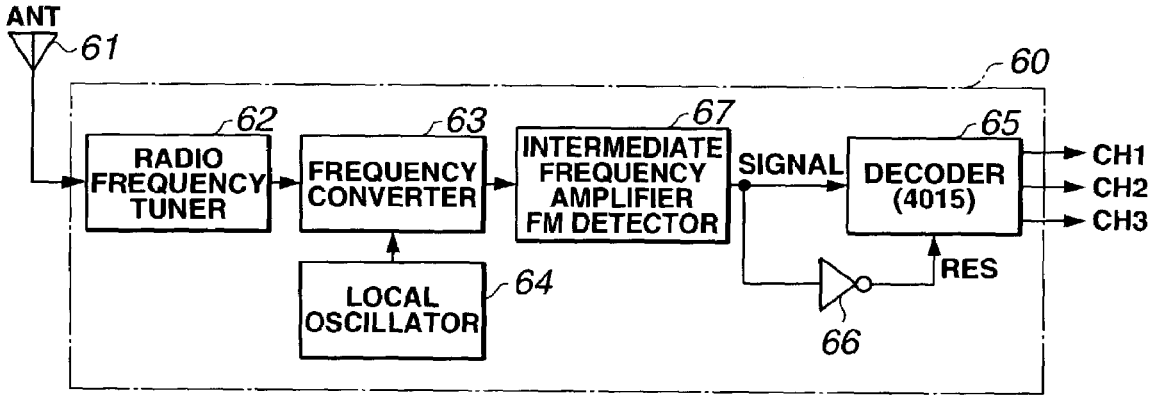
FIG. 9 is a block diagram showing the configuration of a receiver mounted on the radio-controlled car shown in FIG. 8.

FIG. 2 shows a configuration of the transmitter 1. The transmitter 1 consists of a radio control unit 2, an encoder 3, a high-frequency section 5, and an antenna 6. The transmitter has a configuration similar to that in FIG. 8 but a modulation-signal reference-value addition circuit 4 is added and will be explained below in detail. The radio control unit 2 is formed of joysticks 2*a* each for steering a mobile object (or an object to be controlled), for example, a radio-controlled model car, and various setting switches. As a joystick 2*a* operates, the corresponding volume 2*b* rotates at the same time. Thus, the voltage indicated by the volume 2*b* creates a control signal proportional to the rotational angle of the joystick. The control signal is converted into a potential difference and corresponds to the neutral point of 0 of the joystick. Various potentials are applied to the neutral point of the control signal to make a voltage range which is convenient in use. The encoder 3 produces various control signals output from the steering gear 2 as a serially arranged pulse chain, concluded with a predetermined period, that is, subjects them to the so-called PPM conversion. During control of a radio-controlled model car, the high-frequency section 5 (transmission section) receives the pulse chain and then constantly transmits FM- or AM-modulated carriers via the antenna 6. Radio waves of a specific frequency selected among plural frequencies belonging to the frequency band for radio-control only are used as the carrier transmitted from the antenna 6.

Figure 3A:
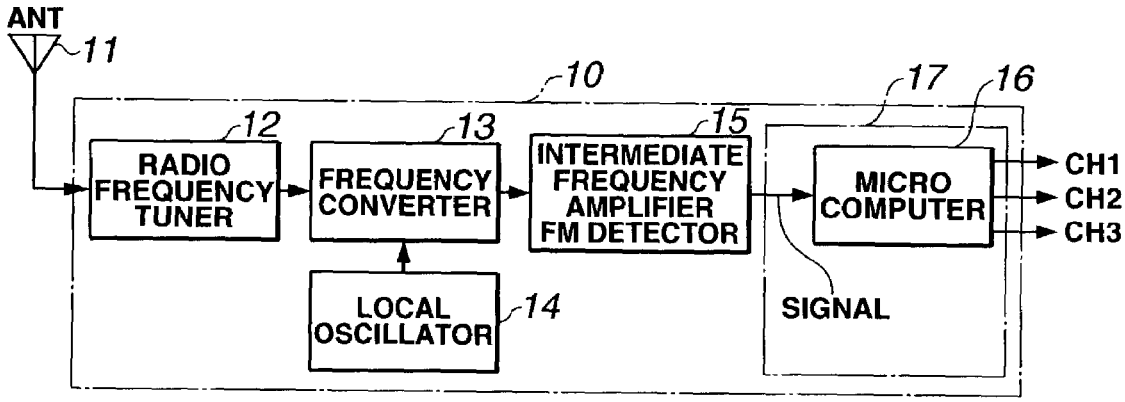
FIG. 3(*a*) is a block diagram illustrating the circuit configuration of a receiver constituting a radio-controlled device according to the present invention, and FIG. 3(*b*) is a structural diagram illustrating a servo control section.
Figure 3B:
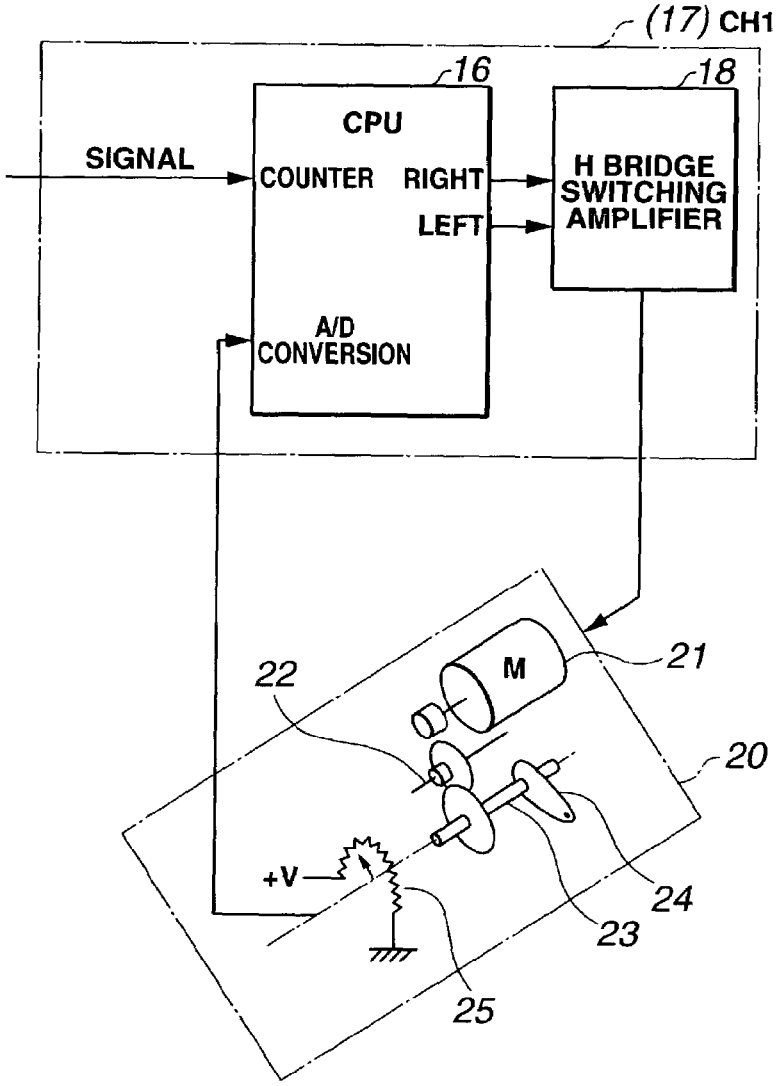

The receiver portion mounted on a radio-controlled model car will be explained below in accordance with FIG. 3. FIG. 3(*a*) shows the entire configuration of the receiver and FIG. 3(*b*) shows in detail a servomechanism and the drive circuit therefor. The antenna 11 receives radio waves transmitted from the transmitter. The receiver 10 decodes the radio waves. The receiver 10 includes a tuner 12, a local oscillator 14, a converter 13, and a FM detection circuit 15 having an intermediate frequency amplifier. The microcomputer 16 receives the decoded signal as pulse signals with time widths to control the servomechanisms of respective channels.

FIG. 3(*b*) shows a digital servomechanism and a servo control section for controlling the digital servomechanism. In each channel, the servomechanism basically has substantially the same configuration. FIG. 3(*b*) shows one channel (e.g. CH1) only. The servo control circuit (17) is instructed by the control pulse allocated to each channel and controls the rotation of the servomotor 21 in the digital servomechanism 20 so as to set the output shaft thereof to a predetermined position (a rotational angle).

Referring FIG. 3(*b*), the functions only related to the servo control circuit are excerpted from the functions of the microcomputer (hereinafter often referred to as a CPU) 16. The H-bridge switching amplifier 18 obeys instructions from the CPU 16 and drives the servomotor 21 within the digital servomechanism 20. The servomechanism 20 drives clockwise or counterclockwise the output shaft 23 in accordance with the rotation of the servomotor 21 and via the gear train 22, and thus converts electrical signals into mechanical displacements. The gear train 22 decelerates the output shaft 23 to increase the torque. With movement of the tip of the horn 24 securely fixed on one end of the output shaft 23, the steering mechanism of the radio-controlled model car 15 is operated via, for example, the push rod. A potentiometer 25 is connected to the other end of the output shaft 23. The CPU 16 AD-converts the rotational angle of the output shaft 23 as a potential difference of the potentiometer 25.

The CPU 16 receives the control pulse signal Sig from the FM detector 15, restores it to a pulse (time) width proportional to the joystick operation angle, and then separates the restored signal by channel. The separated signals are input to the counter of the CPU 16 within the servo control circuit (17). Thus, the counter measures the pulse width so that the target position of the instructed servomechanism is known. The target position is compared with the AD-converted indication of the potentiometer 25, corresponding to the current position of the digital servomechanism 20. Thus, the clockwise or counterclockwise rotational direction of the motor is determined. The CPU 16 outputs the rotational direction to the H-bridge switching amplifier 18 and thus drives the servomotor 21 clockwise or counterclockwise. Comparing the instructed target position of the servomechanism 20 with the indication of the potentiometer 25 is performed continuously. When the rotational position of the output shaft 23 reaches a target position, the servomotor 21 halts. The H-bridge switching amplifier 18 may be a semiconductor electronic forward/reverse rotary switch.

Figure 4A:
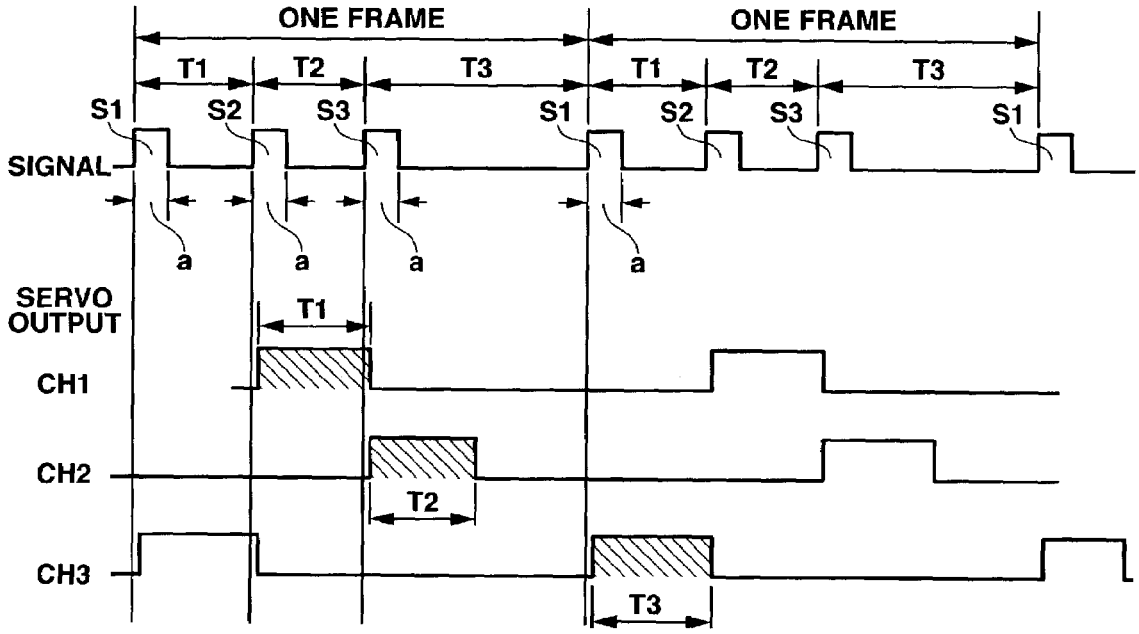
FIG. 4(*a*) is a diagram showing a format of PPM signals used for a radio-controlled transmitter according to the present invention, and FIG. 4(*b*) is a schematic diagram explaining relationships between operation angles of a joystick of a radio-controlled transmitter and pulse time of a PPM signal.
Figure 4B:
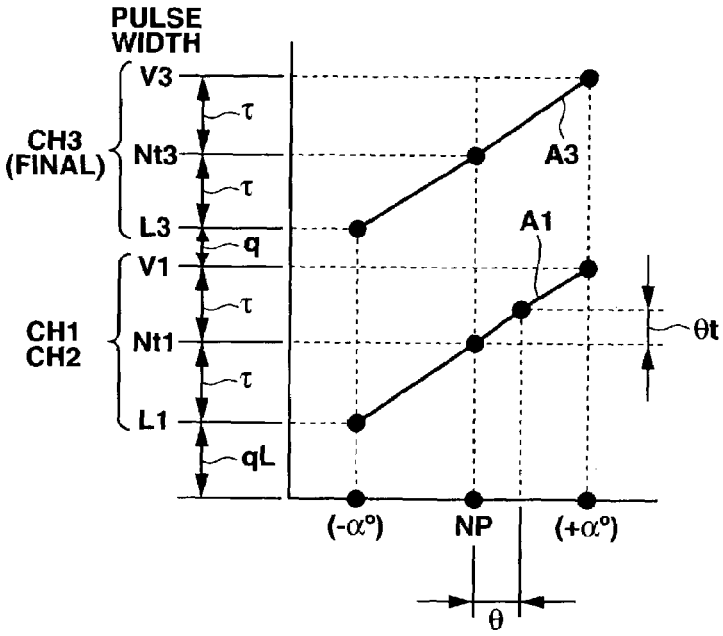

Referring to FIG. 4(*a*), a pulse format of signals transmitted from a radio-controlled device according to an embodiment of the present invention will be explained below. FIG. 4(*a*) shows a three-channel signal format for a radio-controlled model car, PPM modulated (pulse position modulation), with changes of signals along the horizontal axis (the time axis running from right to right). For example, signals of respective channels are serially arranged in the order of channel numbers and are sequentially processed over time. Here, explanation will be made by assuming that the channels CH1, CH2, and CH3 are sequentially arranged and the order is unchanged. The signal corresponding to each of the channels CH1, CH2, and CH3 begins with one-shot pulse S (with a duration of a μs). Signal T1, T2, or T3 corresponds to the time width between the beginning of one-shot pulse S and the beginning of the next one-shot pulse S. Symbol S1 is denoted to the one-shot pulse at the beginning of CH1 and symbols S2 and S3 are denoted to one-shot pulses corresponding to CH2 and CH3, respectively.

The signals T1 and T2 are output to the servo outputs CH1 and CH2, respectively, without any change. However, the signal T3 having a time width of t3 is output to the servo output CH3. The transmitter processes the time width of the control signal output to the final channel CH3 and transmits the signal of the time width of T3, which is the sum of the time width t3 indicating a position of a joystick and a constant time period. The CPU 16 has the function of subtracting an added constant time period from T3 to restore the time width t3 indicating the position of the joystick on the receiver side. In other words, the modulation signal reference value addition circuit 4 in the transmitter 1 shown in FIG. 2 adds a constant time period to the time width t3 indicating the joystick position and thus transmits a control signal with the time width T3 . The constant time period is called a reset reference value.

Figure 10:
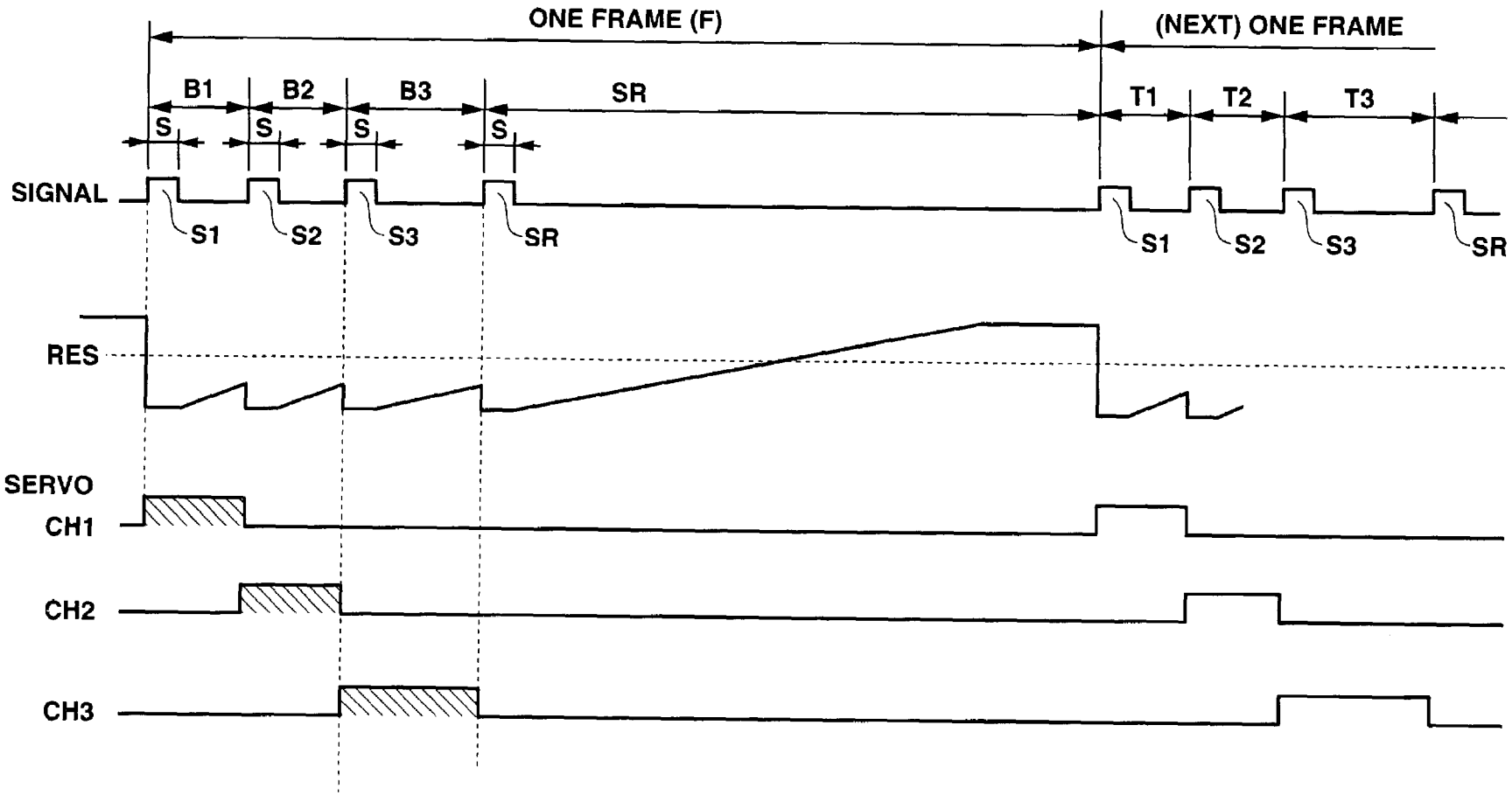
FIG. 10 is a conventional signal format used for a radio-controlled device.

In transmission, the reset reference value is added in the final channel in such a way that the signal T3 corresponding to the final channel CH3 works simultaneously as a reset pulse determining a break between frames. In comparison with the conventional signal format shown in FIG. 10, the reset pulse SR shown in FIG. 10 is omitted in FIG. 4.

The beginning of one-shot pulse S2 is output as a trigger to the channel CH1 of a servomechanism. The beginning of one-shot pulse S3 is output as a trigger to the channel CH2 and the beginning of one-shot pulse S1 is output as a trigger to the channel CH3. Thus, the one-shot pulses S2, S3, and S1 are output to the servomechanisms while the output timings thereof are shifted to improve the reliability. The CPU 16 used in the receiver can shift the trigger output timing, unlike the conventional example shown in FIG. 10. Because of reasons for control, T1, T2, and T3 begin from the beginnings of one-shot pulse S1, S2 and S3, respectively, with a delay of, for example, 100 μs.

FIG. 4(*b*) is a graph plotting the relationship between a joystick operation angle and a time width of a signal. Referring to FIG. 4(*b*), the horizontal axis represents a joystick operation angle and the vertical axis represents a time width of a signal. The joystick angles of the channels CH1 and CH2 are converted into time on the vertical axis, in accordance with the linear line A. The joystick angle of the final channel CH3 is converted into time on the vertical axis in accordance with the linear line A3. The movement ranging from the neutral position NP of a joystick to a maximum displacement position ($\alpha°$) is converted into a signal time width. When the converted time width is τμs on either side of a joystick, 2 τμs is required on both the upper and lower sides (corresponding to $\pm\alpha°$). The neutral position of the signal T1 corresponding to the channel CH1 is Nt1 μs and the neutral position of the signal T2 corresponding to the channel CH2 is Nt1 μs. τμs is set on either side with respect to the neutral position. Thus, the region between the signal upper limit U1 and the signal lower limit L1 is defined as a signal existence time area of the signal T1, T2. As described above, the neutral position (Nt1) of the control signal corresponds to the neutral point of a joystick and exists in the area of ±τμs. In other words, τμS is called a maximum half-width time of a control signal. The neutral position Nt1 is called a modulation signal reference value. The neutral position Nt3 is a reset modulation signal reference value. The signal lower limit value L1 is larger than zero by qL μs, where qL is the sum of a time twice a continuous time (a) of one-shot pulse S and a margin time q1.

Similarly, the neutral position of the signal T3 corresponding to the final channel CH3 is Nt3 μs. τμs is set on either side with respect to the neutral position. The region between the signal upper limit value U3 and the signal lower limit value L3 is defined as the signal existence time area of the signal T3. Like CH1 and CH2, τμs is called a maximum half-width time of a control signal and the neutral position Nt3 is called a reset modulation signal reference value. In order to specify the final channel, the signal existence time area of the normal signal T1, T2 and the time existence time area of the final signal T3 are arranged in such a way that they are not overlapped to each other. That is, the signal lower limit L3 of the final channel CH3 is at least larger than the signal upper limit U1 of the normal signal CH1, CH2. In order to distinguish certainly the final channel from other channels, it is desirable to insert a margin width, or the so-called margin time (q), between the signal upper value U1 of the normal channel CH1, CH2 and the signal lower limit value L3 of the final channel CH3. As described previously, the time difference between the neutral position Nt3 μs of the signal T3 corresponding to the final channel CH3 and the neutral position Nt1 μs of the signal T1, T2 corresponding to the channel CH1, CH2, is referred to as a reset reference value R (=Nt3(μs)−Nt1(μs)).

In the transmitter shown in FIG. 2, the modulation signal reference value addition circuit 4 acts as modulation signal reference value addition means. The modulation signal reference value addition circuit 4 has the function of adding a modulation signal reference value or a reset modulation signal reference value in the final channel, to the time width θt (shown in FIG. 4(*b*)) corresponding to the position of the joystick 2*a* of the steering gear 2. The modulation signal reference value addition means may be realized as the function of the CPU integrated in the transmitter. In the receiver, the microcomputer 16 has the function of subtracting, when the signal Sig input from the FM detection circuit 15 has a time width within the signal existence time area of the final signal T1, the reset reference value R from the time width and then outputting the difference to the servo control circuit 17. In other words, the microcomputer 16 has reset reference value subtraction means. The transmitter has the modulation signal reference value addition means. The receiver has the reset reference value subtraction means. This configuration does not require an independent reset pulse. One frame can be configured with one-shot pulses (S1, S2, . . . , S(N−1), S(N)) only as many as the number of channels.

An example of allocating a specific time for each signal time will be explained by referring to the table shown in FIG. 5. Respective symbols are equivalent to those in FIG. 4. First, to maintain the harmonic components (carriers) of radio waves for radio control to a small value, the time duration (a) of one-shot pulse S is required to be, for example, 400 μs. The following non-signal duration is set to a minimum value of 400 μs. That is, a margin width 2(q1) of 100 μs or more is added to 800 μs, being the sum of the time duration (a) and the non-signal duration, (that is, qL=2*a*+q1). According to the conventional value, the margin width 2(q1) is 120 μs and the signal lower limit value L1 of the signal T1, T2 is 920 μs.

Next, experience shows that the signal time corresponding to the total travel amount of a joystick is an adequate time width of 1200 μs (±τ=600 μs). When the neutral point of a joystick is set as the center of an entire travel amount and 600 μs is set in either direction from the center, the neutral position N1 of the signal T1, T2 is 1520 μs (=920 μs+600 μs). The signal upper limit value U1 is 2120 μs (=1520 μs+600 μs). The conventional numerals are used, without any change, as the main time widths used to the signal format, including the time duration (a) of one-shot pulse S, a non-signal time duration following the time duration (a) and a signal time corresponding to the entire travel amount of a joystick. The time widths proven are adopted and are sufficiently safe in a signal format.

In the signal T3 corresponding to the final channel CH3, 2520 μs (=2120 μs, being a signal upper limit value of the signal T1, T2, +400 μs, being a margin width q) becomes a signal lower limit value. Like the signal T1, T2, with the neutral point of a joystick being the center of the entire travel amount thereof and with ±600 μs set on either side with respect to the center, the neutral position N3 of the signal T3 becomes 3120 μs. In the signal T3, the maximum signal time duration is 3720 μs and signal existence time area is 2520 μs to 3720 μs. The CPU used in the receiver enables digital control and improves the counter accuracy. Hence, even the margin width q of less than 400 μs between two signal existence time bands is sufficiently practical.

Using the reset reference value R described previously, the neutral position Nt3 (a reset modulation signal reference value of 3120 μs) may be translated into the neutral position Nt1 of the signal T1, T2 (a modulation signal reference value of 1520 μs) plus a reset reference value R (2τ+q=1600 μs). In an actual example of use, the time widths of signals on the carrier may be often compressed. However, since many intermingled figures lead to a complicated explanation, it is assumed that the time widths of signals do not change within the transmitter or within a radio-controlled model car after reception of the carrier.

In general radio-controlled devices using N channels, a signal exists in the signal existence time area of 600 μs on either side with respect to a modulation signal reference value (1520 μs) in channels CH1 to CH(N−1). In the final channel CH(N) only, a signal exists in the signal existence time area of 600 μs on either side with respect to a reset modulation signal reference value (3120 μs), to which the reset reference value R is added. As described above, according to the present invention, a first feature of the new format is the steps of adding a reset reference value R to the final channel only on the transmitter side in such a way that the signal existence time area of the final signal is not overlapped with that of another signal, subtracting the reset reference value R when the receiver side receives the signal for the final channel, and then supplying the restored signal to the servomechanism driving section.

Next, the final channel is determined utilizing the signal existence time area of the final channel which is not mixed with that of another channel. Thus, the signal existence time area of the final channel can be used as a reset pulse. By referring to the flowchart for a transmitter shown in FIG. 6 and the flowchart for a receiver shown in FIG. 7, the procedure of adding the reset reference value R in the transmitter and subtracting the reset reference value R in the receiver. Moreover, by referring to the flowchart for a receiver shown in FIG. 7, the procedure of determining the final channel in the receiver will be explained below.

Figure 6A:
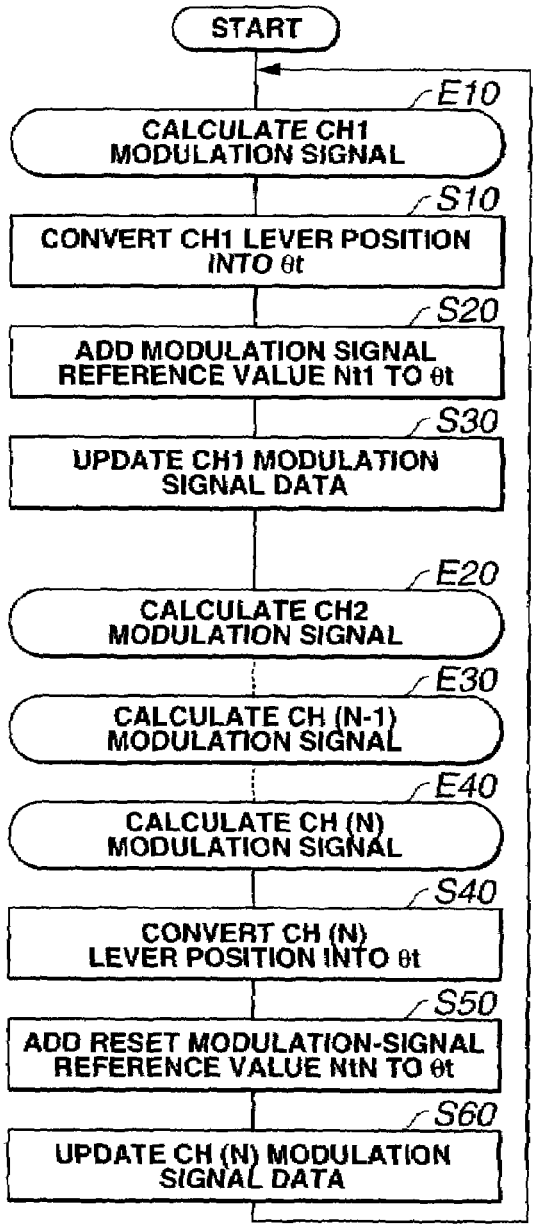
FIGS. 6(*a*) and 6(*b*) show flow charts explaining an operation of a radio-controlled transmitter according to the present invention.
Figure 6B:
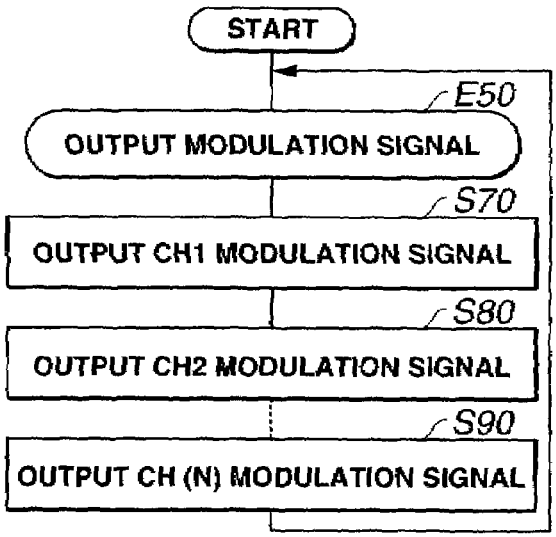

FIG. 6(*a*) shows a procedure of calculating modulation signals in the transmitter. FIG. 6(*b*) shows the output procedure for modulating a carrier with a modulation signal calculated through the procedure shown in FIG. 6(*a*). The transmitter begins its reading operation from the channel 1 (CH1) (E10)). In the step S1, the angular position of the transmitter lever joystick) for the channel CH1 is converted into the time θt. By referring to the graph shown in FIG. 4(*b*), the position θ° of the transmitter joystick in the channel CH1 is converted into a pulse width θt from the neutral position along the linear line A1. In the step S20, the modulation signal reference value Nt1 corresponding to the time of the neutral position is added to θt so that new signal data (Nt1+θt) is obtained. In the step S3, the new (modulation) signal data for the channel CH1 is input to the memory to rewrite the data therein. Next, the modulation signal reference value Nt1 is added in a procedure similar to that for the channel CH1. Then, new (modulation) signal data for the channel CH2 is input to a predetermined location in the memory (E20). In the case of three channels, that operation is performed to the channels CH1 and CH2. In the case of N channels, the same adding procedure described above is applied to the channels CH1 to CH(N−1), except the final channel (E20 to E30).

The step E40 is applied to only the final channel CH(N). In the case of the tree channels, the step E40 is implemented to the channel CH3. In the step E40, the position of the transmitter joystick is converted into a pulse width from its neutral position. This procedure is equivalent to that in the step S10. In the step S50, the reset signal reference value (Nt(N), or Nt3 in FIG. 4(*b*)) is added to the time duration θt so that new signal data (Nt(N)+θt) is obtained. In the step S60, the new (modulation) signal data (Nt(N)+θt) for the channel CH(N) is input to rewrite the content of the memory. As a result, all sets of new data corresponding to the channels CH1 to CH(N) for one frame has been obtained. Because reading the next frame begins with the channel CH1 in a manner similar to that described above, the transmitter waits at the START point until a reading instruction comes.

FIG. 6(*b*) shows the procedure (E50) for outputting modulation signals. The (modulation) signal data stored is sequentially output in accordance with the procedure of steps S70 to S90 and are PPM-modulated into a pulse chain shown in FIG. 4(*a*). Then, the modulated data is transmitted.

Figure 7A:
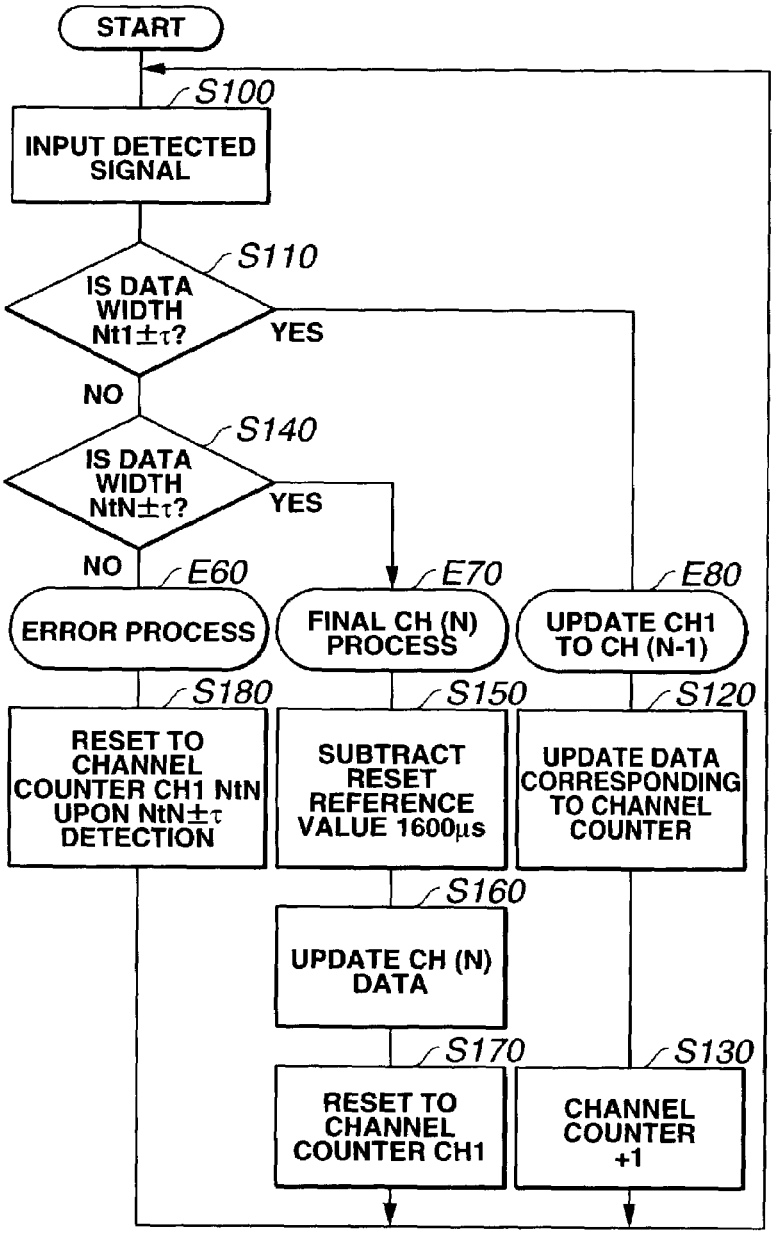
FIGS. 7(*a*) and 7(*b*) show flow charts explaining an operation of a radio-controlled receiver according to the present invention.
Figure 7B:
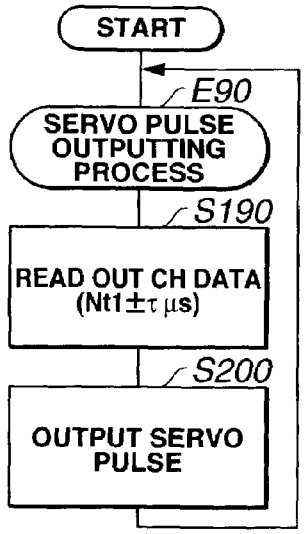

Next, an operation of the receiver will be explained below in accordance with the flow chart shown in FIG. 7. FIG. 7(*a*) shows the procedure of selecting respective channels and FIG. 7(*b*) shows the procedure of outputting data to a servomechanism. Explanation will begin with the point when the FM detector 15, shown in FIG. 3(*a*), inputs the signal Sig to the microcomputer 16. The signal Sig (see the upper portion of FIG. 4(*a*)) is a chain of one-shot pulses S1, S2, and S3, each of which the time interval corresponds to the operation angle (position) of a joystick.

First, the case where radio waves are been smoothly received without obstacle noises will be explained here. The channel counter on the receiver side is accurately set to the next channel. In such a case, the channel counter sets to the next channel by incrementing the channel counter every time one-shot pulse S is received. In the step S100 of FIG. 7(*a*), the microcomputer 16 receives the detection signal. It is now assumed that the first pulse is one-shot pulse S1 indicating the beginning of the channel CH1. Successively, one-shot pulse S2 is input and then the data width (time interval) T1 is measured. In the step S110, whether or not the data width of the signal is within the data width (Nt1±τ) of each of the channels CH1 to CH(N−1) is determined. If the width of the signal is within the data width (Nt1±τ), it is regarded as data of each of the channels CH1 to CH(N−1), thus being transmitted to E80. In the step S120, the memory data corresponding to the current position CH1 of the channel counter is updated as new data. Next, one increment is added to the channel counter in the step S130 and the result is handled as the channel CH2. Subsequently, the channel counter is updated every time one-shot pulse S is input.

In the case of the final channel CH(N), the signal data has a data width of (Nt(N)±τ) because the reset signal reference value R is added. Consequently, NO in the step S110 and YES in the step S140 are determined and the process in the step E70 is performed. In the step S150, the reset reference value R (1600 μs) is subtracted from the signal data. Like the other channels CH1 to CH(N−1), the signal data exists in the signal existence time area of 600 μs on either side with respect to the modulation signal reference value (1520 μs). The memory is updated from the signal value to new data of the final channel (S160).

In the step S170 of E70 in FIG. 7(*a*), the channel counter is set to CH1 (S170). When the final channel is input, the channel counter is automatically reset to the channel CH1. Since the final channel is confirmed every frame, the receiving state is monitored at all times. This prevents the channel on the transmitter side and the channel on the receiver side from being shifted.

When a noise pulse, except signals transmitted by the transmitter, invades or one-pulse S is skipped because of bad receiving conditions, the signal width may deviate from the normal signal data width (Nt1±τ or Nt(N)±τ). This state is called an error. The error state causes NO in the step S110 and YES in the step S140. Thus, the flow goes to the error process (E60). In such a state, because all signals input to E70 or E80 are cut, the E70 or E80 process is not performed. For recovery from an error state, it is necessary to detect the recovery of the receiving state and to specify the received channel and to match the channel counter to it. When the reception of the final channel is confirmed, data is taken in from the beginning of the next frame. In the flow chart, when the step S140 is, for example, YES, the channel counter is reset to the channel CH1 in the step S180 while the steps S110 and S140 go to a normal operation state, that is, to the process E80 and E70 in decision YES, respectively. In the erroneous state, the method of maintaining the operational state of a servomechanism or a special countermeasure is often taken but the detail is omitted here.

A stored signal width is distributed to each servomechanism in the servo-pulse outputting process (E90), shown in FIG. 7(*b*), to drive it. Each of all sets of the stored data, including data on CH(N), corresponds to a time width of (Nt1±τ). Hence, the latest updated data read out from the memory in the order of channels corresponds directly to the position of a joystick. Data is taken out with the next one-shot pulse S acting as a trigger but is delayed by one-shot pulse S.

As shown in FIG. 4(*a*), the signal width of channel CH1 is T1. When one-shot pulse S2 is triggered, the pulse with a width T1 (shaded portion) is transmitted as the servo output of the CH1. Strictly speaking, the pulse T1 rises up with a slight delay of, for example, 100 μs from the beginning of one-shot pulse S2. The pulse with a width T2 in CH2 rises up when one-shot pulse S3 is triggered. The pulse with a width T3 in CH3 rises up when the next one-shot pulse S1 is triggered. In other words, with the next coming one-shot pulse S acting as a trigger, the servo pulses in CH1 to CH3 are sequentially taken out and distributed to corresponding servomechanisms respectively.

As described above, the prior-art independent reset pulse is included in the signal width of the final channel. By doing so, the frame time period of about 14 ms required in the prior art can be shortened to a frame time period between a shortest time of 4.36 ms and a longest time of 7.66 ms. Moreover, the use of the digital servomechanism does not require a fixed time width of one frame. Although the frequency of appearance of an actual signal width is obtained through accurate measurement, the frame width may be shortened to about 60% on average.

As described above, the reduction of the frame time period allows the non-operation area of a servomechanism, in which the travel amount of a joystick cannot be read in, to be halved from several tens ms (in prior art) to a maximum time of 7 ms. This can resolve the problem that the servomechanism cannot follow a quick motion of fingers of top-level players. The present invention adopts digital servomechanisms and introduces the digital-process technique comprehensively in the receiver. Moreover, one-shot pulse in the final channel, which acts as the reset pulse required independently in prior art, can largely reduce the frame time period, thus improving the steering response. In other words, high-performance radio control devices, which satisfies first-ranked players, can be put on the market.

The increased maneuvering response characteristic contributes to gaining high appraisal in the radio-controlled device market and increasing sales promotion effects. The present invention can realize a reduced entire frame width and an improved steering response, without changing the channel width forming the PPM signal. Even if the frame width is reduced, the main numerical values of signal ratings, such as the pulse width of one-shot pulse and a maximum half-width time of a signal, are used, without changing conventional familiar values. Hence, it is predicted to bring the effects of harmonic waves or others on carriers to an allowable range. Advantageously, the present invention does not adversely affect the stability of a radio-controlled device.

Obviously, many modifications and variations of the present invention are possible in the light of the above teachings. It is therefore to be understood that within the scope of the appended claims, the invention may be practiced otherwise than as specifically described.

What is claimed is:

1. A radio-controlled device, comprising:

a transmitter for serially arranging control signals in plural channels and transmitting said control signals as PPM-modulated carrier waves;

a receiver for receiving and decoding said carrier waves and thus restoring said carrier waves to control signals for said plural channels; and a servomechanism for converting said plural control signals into mechanical displacements, respectively;

said transmitter having modulation-signal reference value addition means for adding a modulation-signal reference value to control signals of remaining channels, except a final channel arranged at the end of said plural channels, and adding a reset modulation-signal reference value to only said control signal of said final channel; and said receiver having reset reference value subtraction means for subtracting a reset reference value from said control signal of said final channel decoded.

2. The radio-controlled device as defined in claim 1, wherein said servomechanism comprises a digital servomechanism.

3. The radio-controlled device as defined in claim 1 or 2, wherein said reset reference value is larger than a value twice at least a maximum half-width time of said control signal.

4. The radio-controlled device as defined in claim 3, wherein said reset reference value is obtained by adding a predetermined margin time to a value twice the maximum half-width time of said control signal.

* * * * *